US005138828A

United States Patent [19]

Stahlecker

[11] Patent Number: 5,138,828

[45] Date of Patent: Aug. 18, 1992

[54] SPINNING FACILITY HAVING AT LEAST ONE EXCHANGING CART FOR THE EXCHANGE OF CANS

[75] Inventor: Fritz Stahlecker, Bad Überkingen, Fed. Rep. of Germany

[73] Assignee: Hans Stahlecker, Fed. Rep. of Germany; a part interest

[21] Appl. No.: 572,228

[22] Filed: Aug. 24, 1990

[30] Foreign Application Priority Data

Aug. 30, 1989 [DE] Fed. Rep. of Germany ..... 3928648

[51] Int. Cl.[5] ..... D01H 9/10; D01H 13/02

[52] U.S. Cl. ..... 57/281; 57/90

[58] Field of Search ..... 57/90, 281, 268, 270, 57/275; 19/150, 159 A; 414/744.4, 744.5

[56] References Cited

U.S. PATENT DOCUMENTS

| | | | |
|---|---|---|---|
| 3,884,026 | 5/1975 | Yoshizawa et al. | 19/159 A X |
| 4,012,893 | 3/1977 | Weber | 19/159 A X |
| 4,150,534 | 4/1979 | Raasch | 57/281 |
| 4,293,272 | 11/1980 | Jellema | 414/744.5 |
| 4,694,539 | 9/1987 | Langen | 19/159 A |
| 4,735,040 | 4/1988 | Pircher | 19/159 A X |
| 4,753,065 | 6/1988 | Mack et al. | 57/281 X |
| 4,932,201 | 6/1990 | Meroni et al. | 57/281 X |
| 4,969,323 | 11/1990 | Stahlecker | 57/90 |
| 4,972,669 | 11/1990 | Raasch | 57/90 X |
| 4,995,140 | 2/1991 | Guenkinger et al. | 79/159 A |

FOREIGN PATENT DOCUMENTS

| | | |
|---|---|---|
| 2352649 | 6/1977 | Fed. Rep. of Germany . |
| 2536435 | 2/1984 | Fed. Rep. of Germany . |
| WO/06358 | 11/1986 | Fed. Rep. of Germany . |

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

For a facility having one or several spinning machines and having at least one exchanging cart for the exchange of empty cans for full cans, it is provided that the exchanging cart is provided with devices for carrying out different exchange operations for making exchanges in the front or the back row which are triggered by signals as a function of depositing locations which are firmly assigned to the spinning points.

17 Claims, 6 Drawing Sheets

SPINNING FACILITY HAVING AT LEAST ONE EXCHANGING CART FOR THE EXCHANGE OF CANS

BACKGROUND AND SUMMARY OF THE INVENTION

The invention relates to a facility having one or several spinning machines and at least one exchanging cart for the exchange of empty cans for full cans which contain a sliver to be processed and which are deposited in two rows behind one another along the respective spinning machines.

In the case of spinning machines, particularly open-end spinning machines, the fiber material to be processed is presented as a sliver in cans. In this case, one can respectively is assigned to one spinning point. In order to be able to make available a sufficient quantity of sliver for the high working speeds, the cans are relatively large so that the cans which are in use are placed in two rows and the cans of both rows are in use. The exchanging of the cans today, as a rule, is still carried out manually although several solutions have become known for an automatic can exchange.

It is known (WO 86/06358) to assign two cans to each spinning point which are placed in two rows behind one another. In this case, the cans of the front row are used as spare cans which are to replace the cans of the rear rows which are being used alone. When the can of the rear row is empty, the front can which will then be in use is taken out by means of an exchanging cart without an interruption of the work; then the empty rear can is taken out; and subsequently, the can which is in use is placed in the rear row. Then a full can is placed in the front spare row. This type of an exchange of cans is limited to machines where the can being used can be placed in a row.

It is also known from German Patent Document DE-C 25 36 435 to arrange one can respectively of the front and the back row on a carriage that can be moved out transversely to the spinning machine and that is pulled to the front by an exchanging cart when an exchange of cans is to be carried out. In this case, the rear can may then also be exchanged.

It is also known from German Patent Document DE-PS 23 52 649 to place the cans in three rows of which the respective two back rows are in use. The cans of the row in the very front are used as spares. The cans of the back row are filled at the beginning only half full, whereby it is to be ensured that these cans are processed first. An exchange will then take place as the result of the fact that the cans are displaced transversely with respect to the machine so that the then empty can is delivered to a conveyer belt extending in parallel to it, while the can of the second row will then move into the position of the back row. The spare can is then brought into the position of the second row. In addition, new full cans are then made available again in the first row. An exchange of cans of this type can function only if it may be assumed that the cans will always be processed uniformly; i.e., that the cans of the second row are still half full, when the can of the rear row becomes empty. In the case of many spinning machines, this type of a uniform processing does not take place, for example, in the case of open-end spinning machines. As a result of stoppages at the individual spinning points because of yarn breakages or the like, it cannot be ensured that all cans are processed uniformly. It cannot be excluded that the can of the second row may no longer be half filled when the can of the back row is empty. Should this happen, the whole system would be in disarray. It is an object of the invention to develop a facility of the initially mentioned type in such a manner that, if required, an exchange of cans is always possible in the front row as well as the back row irrespective of whether a can of the front row or the back row is worked empty earlier or later.

According to a first development according to the invention, this object is achieved in that an exchanging cart is equipped with devices for carrying out two different exchange operations, of which one operation is intended for the exchange of the cans in a position of the front row, and the other one operation is intended for the exchange of the cans in a position of the back row, in that a depositing location for the pertaining can in the front row or the back row is assigned to each spinning point, and in that devices are provided for supplying information to the exchanging cart concerning the position of the depositing location of the can of the spinning point to be serviced, and for triggering the exchange operation intended for this position.

In this development, the exchanging cart is constructed such that it can selectively carry out an exchange of a can in the front row or of a can in the back row, in which case the respective required operating cycle is triggered by an information signal which indicates in which position the can of the spinning point that has to be serviced is situated.

In a further development of this first construction, it is provided that the exchanging cart is equipped with devices for making a can of the back row accessible by moving out the can in the front row situated in front of it, depositing it intermediately and returning it. For making this can accessible, the devices may be used that are used in the other exchanging operation; i.e., during the exchange of a can of the front row.

In a further development of the invention, the object is achieved by means of the fact that the exchanging cart is equipped with devices for displacing a can of the front row in a depositing location of the back row and for the simultaneous moving of the can previously situated in the back row to a conveying device extending along the back row, and with devices for depositing a full can in the depositing location of the front row which now has become vacant. In this development, these devices will be used when a can of the back row must be exchanged. If the cans of the front row are to be exchanged, other devices may be used which are designed specifically for this exchanging operation of the front row which carry out an exchange toward the front.

Since, in this second development, the front cans change their position with the exchanging of the rear can, devices are provided in a further development of the invention for changing the information concerning the changed position of the can displaced from the front to the back row and assigned to a spinning point. During the subsequent can exchange, the exchange cart can then take this new position into account.

In another further development, it is provided that the exchange cart is equipped with devices for cutting a sliver travelling from the can of the front row to the pertaining spinning point. This can will then be separated from the spinning point that previously had been supplied by it with sliver. The sliver of the can pushed into the second row will then, manually or by an automatic device, be supplied to that spinning point to which the depositing location of the back row belongs. The newly supplied full can will then manually or automatically be inserted into the spinning point assigned to this depositing location.

In a further development, it is provided for achieving the object that the exchanging cart is equipped with devices for the successive exchange of the cans standing behind one another in the two rows. These devices can be operated as a function of signals indicating approach of the empty state of the front and/or the rear can, and the exchanging cart comprises devices for cutting a sliver moving from the can of the front row or the can of the rear row to the pertaining spinning point. In this development, an exchange is carried out in each case of the cans of the front and the back row irrespective of whether both or only one have been emptied during the operation. The can which may not yet be empty will be sorted out later and be reused. This solution results in the advantage that no differing exchange operations must be selected in each case.

Other objects, advantages and novel features of the present invention will become apparent from the following detailed description of the invention when considered in conjunction with the accompanying drawings.

DETAILED DESCRIPTION OF THE DRAWINGS

Figure 1:
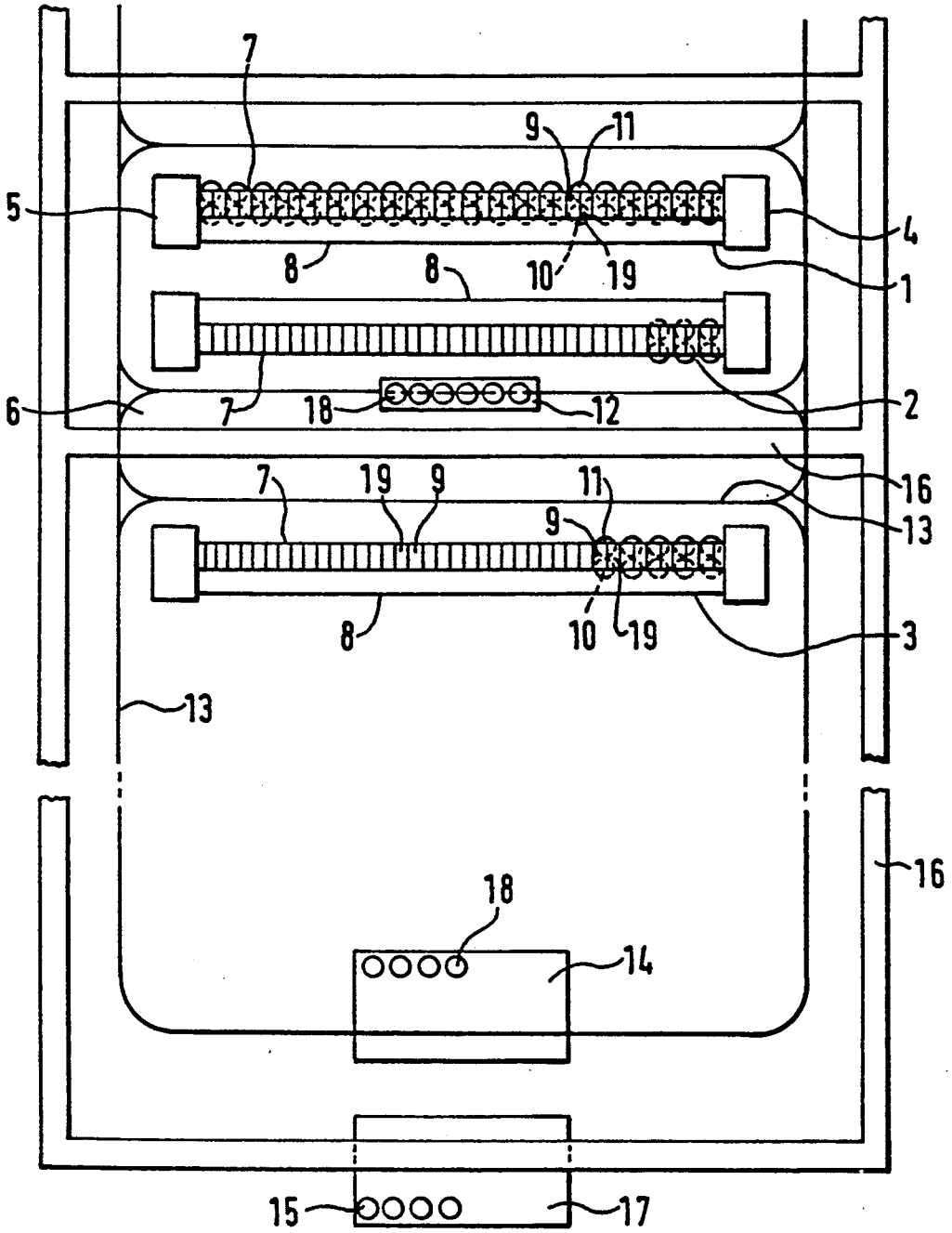
FIG. 1 is a schematic representation of a top view of a facility having several spinning machines, constructed according to a preferred embodiment of the invention.
Figure 2:
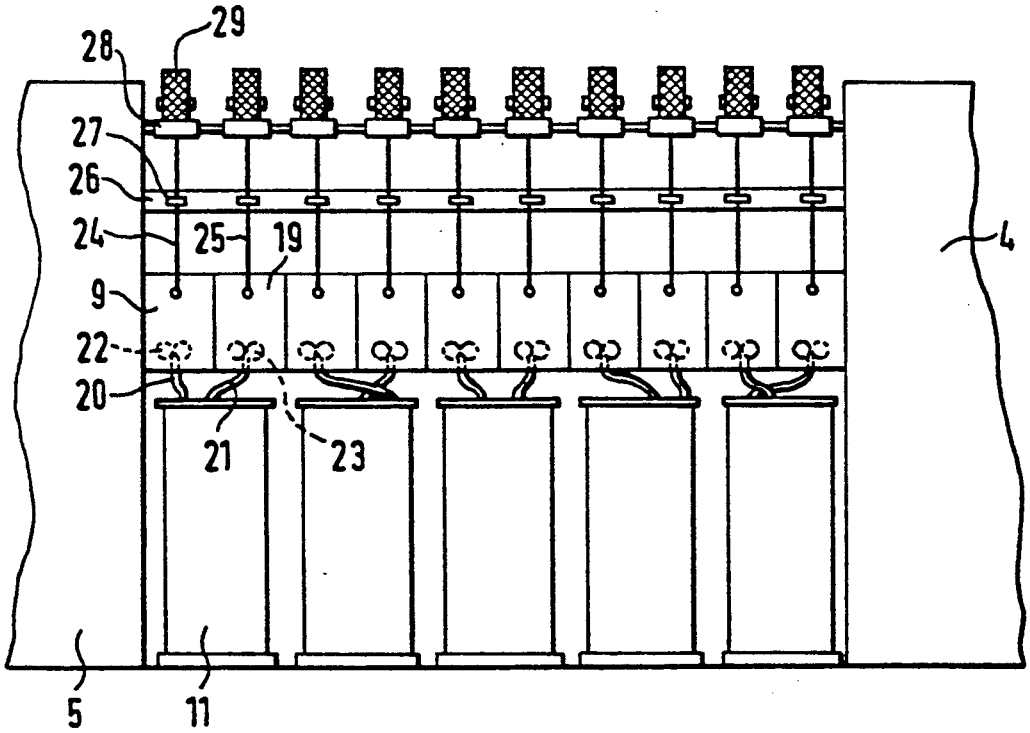
FIG. 2 is a schematic front view of a spinning machine of the facility of FIG. 1.

FIG. 1 illustrates a facility having several spinning machines 1, 2, 3 which each are provided with a plurality of spinning points 9, 19 arranged in a row next to one another at one side of the machine. The spinning machines 1, 2, 3 are aligned in parallel to one another in such a manner that, in each case, one spinning machine with the side having the spinning units 9, 19, i.e., the operating side 7, is opposite the next machine and, with the rear side of the machine, is in each case opposite the preceding one. The one-sided spinning machines 1, 2, 3 should be understood only as an example. A corresponding facility may also be implemented by means of spinning machines which are provided with spinning points arranged in rows on both sides of the machine. In the shown one-sided spinning machines 1, 2, 3, operating paths 6 remain, in each case, between the operating sides and are intended for an operator and also for automatic conveying systems. In the case of two-sided machines, corresponding operating paths 6 would then be between each of the spinning machines.

The individual spinning points 9, 19 of the spinning machine 1, 2, 3 are supplied with a sliver which is taken out of cans 10, 11 by means of a feeding device 22, 23 and is spun into a yarn 24, 25 in the spinning points 9, 19. This yarn is subsequently being withdrawn by means of a withdrawal device which is formed by a continuous shaft 26 and individual pressure rollers 27. Then the yarns 24, 25 are wound up to packages 29 which are driven by a winding roller 28 extending in the longitudinal direction of the machine. The spinning machines 1, 2, 3 are provided with end sections 4, 5 in which drives and deflecting guides as well as transmissions are housed.

In the case of modern spinning machines, the production speeds are high so that it is advantageous, if possible, to make readily available sliver 20, 21 to be processed at the respective spinning point 9, 19 in a can 10, 11. The cans 10, 11 are therefore constructed with diameters which correspond approximately to the width of two adjacent spinning points 9, 19. The cans 10, 11 are arranged underneath the spinning points 9, 19 in two rows behind one another, specifically a front row facing the operating side 7 and having cans 11, and a rear row, which faces away, having cans 10. Advantageously, it is provided that the successive spinning points 9, 19 are in each case supplied by a can 11 of the front row and a can 10 of the back row.

When the sliver 20, 21 has been taken completely out of the cans 10, 11, these cans must be exchanged for full cans; i.e., an exchange of cans must take place. In the embodiment according to FIG. 1, full cans 18 are supplied to the spinning machines 1, 2, 3 by means of a conveying cart 12 which can be moved on a first conveying system 13 between a transfer station 14 and the spinning machines 1, 2, 3 in such a manner that it arrives in the operating paths 6. The empty cans 15 which were taken out of the spinning machines 1, 2, 3 during the exchange by way of a second conveying system 16, are conveyed to a collecting point 17 for the empty cans 15. The two conveying systems 13, 16 are outlined only very schematically. They are designed such that they do not hinder one another. In this case, it is naturally also possible to supply the full cans 18 to the loading station 14 and the collecting station 17, if corresponding changes are made. For example, a conveying device 16 in the form of a conveyer belt system can be used and the empty cans 15 can be removed by means of a cart 12.

The exchanging cart, which carries out the exchange of cans and which will be explained below, is designed such that it can selectively carry out an exchange of cans 11 in the front row or of cans 10 of the back row. When a can 10 or 11 has been spun empty, the corresponding spinning point 9 or 19 emits a signal to the central control device which will then cause the exchanging cart to move to this spinning point 9 or 19. In the central control system, the information had been filed as to whether the spinning point 9 or 19 which is identified, for example, according to an ordinal number, works together with a can 10 or 11 which is situated in the front or in the back row. This information is transmitted to the exchanging cart in such a manner that, on the one hand, this exchanging cart approaches the respective spinning point 9 or 19 and, in addition, already receives the command as to whether it has to carry out an exchange of cans at a can situated in the front or in the back row.

Figure 3:
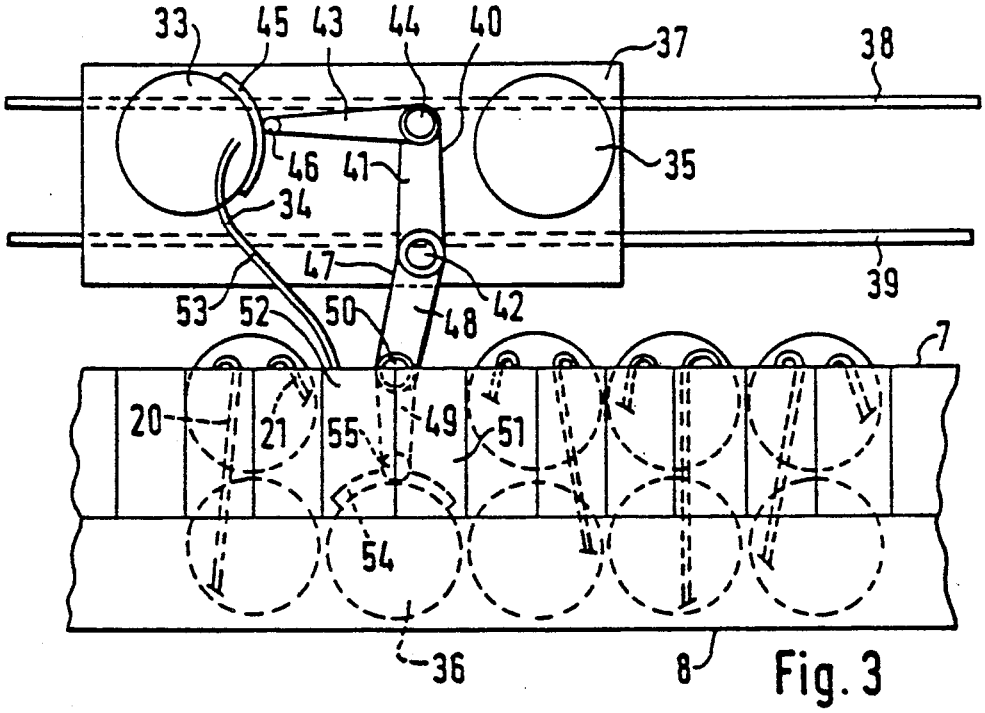
FIGS. 3 and 4 are schematic top views of a first embodiment of an exchanging cart during two stages of its activity.
Figure 4:
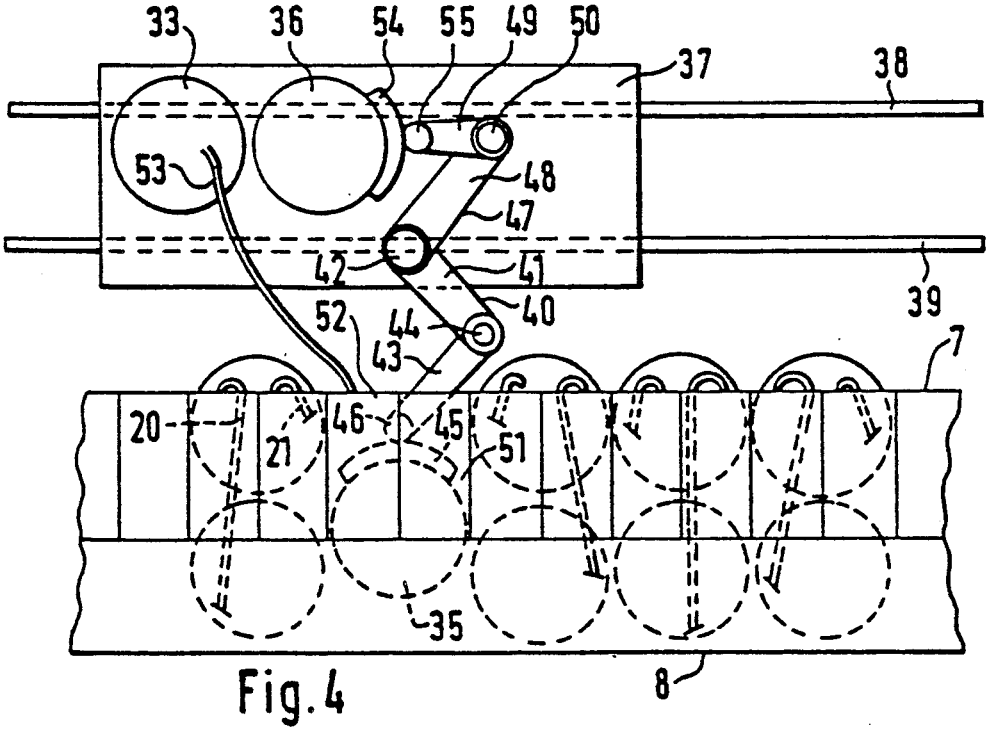

An exchanging cart of this type is shown, for example, in FIGS. 3 and 4. This exchanging cart 37 can be moved on driving rails 38, 39 along the operating side 7 of the spinning machine 1, 2, 3. It has a controlled moving drive which is not shown and by means of which the spinning point 9, 19 where an exchange of cans is required is approached fully automatically.

In the embodiment according to FIG. 3 and 4, it is assumed that, at a spinning point 51, a can 36 which is situated in the back row has run empty. As mentioned above, the exchanging cart 37 has the information that the can 36 to be exchanged has a location in the back row. In order to be able to carry out an exchange of this spinning can 36 from the direction of the operating side 7, the exchanging cart 37 must first make this can accessible. This takes place in that it removes the can 33 which stands in the row in front of can 36 without any impairment of the movement of the sliver 53 moving into spinning point 52, and this sliver can therefore continue to move into the spinning point. The can 36 is made accessible as a result of the fact that the exchanging cart grips the can 33 by means of a gripper 45 and deposits it on its line-up platform. The gripper 45, by means of two lever arms 41, 42, can be moved around a column 42 projecting away from the line-up platform. The lever arms 41, 43 are connected with one another by means of a joint 44. In addition, the gripper 45, by means of a joint 46, is pivotally connected to the lever arm 43. Transmission elements, such as chains or toothed belts, exist between these joints and translate a movement caused by a driving motor integrated into the column 42 into a controlled movement during which the gripper 45 first pulls the can 33 transversely out from under the machine and then swivels it to the depositing platform. At the column 42 of the exchanging cart 37, a second gripper 54 is mounted by way of two levers 48, 49 which are connected with one another by means of a joint 50. By means of another joint 55, the lever 49 is connected with the gripper 54. The levers 48, 49 and the joints 50, 55 are connected with the drive, i.e., a second drive, the column 42, in such a manner that also this gripper carries out a movement transversely with respect to the longitudinal direction of the machine as well as a swivel movement. Gripper 54 takes out the empty can 36 and deposits it also on the depositing platform of the exchanging cart 37 (FIG. 4). In the meantime, gripper 45 has released the can 33 and taken over a full can 35 which has travelled along on the depositing platform of the exchanging cart 37. Gripper 45, by means of a swivel movement and a subsequent transverse movement, guides the full can 35 to the depositing location of the back row which is assigned to spinning point 51. Then gripper 45 moves back. Gripper 45 or gripper 54 then grip the can 33 of spinning point 52 which is still deposited on the depositing platform of the exchanging cart 37 and place it back in its depositing location. Then the exchanging operation is completed so that the exchanging cart 37 drives off with the empty can.

As a modification of the illustrated embodiment, it is also possible that the exchanging cart 37 itself does not carry out the conveying of full spinning cans 35 to the spinning points and the removal of empty spinning can 36 from the spinning points. As shown particularly in connection with FIG. 1, the grippers 45 or 54 of the exchanging cart 37 may also be controlled such that they remove the full can 35 from the cart 12 and deliver the empty can 36 to the conveying system 16.

After the conclusion of the exchange of cans, in which the full can 35 has replaced the empty can 36 of the back row, the sliver of this can 36 must again be inserted in the pertaining spinning point 52. This may take place manually by the operator or by a fully automatic servicing carriage which moves independently of the exchanging cart 37 or together with it.

As mentioned above, a depositing location for a can is firmly assigned to each of the spinning points. The exchanging cart 37 therefore receives the instruction to move to the corresponding spinning point and carry out the exchanging operation assigned to the respective spinning point; i.e., an exchange of cans in the front row or the back row.

An exchange of a can of the front row, for example, of can 33 of spinning point 52, is carried out by means of the above-described devices, the operation being simplified since the can 33 of the front row is already accessible and does not have to be made accessible by the removal of another can. Gripper 45 can then remove the can 33 in the described manner and deposit it on the depositing platform of the exchanging cart 37. Gripper 54 then takes over the full can 35 from the depositing platform and places it in the position of the front row. This then concludes the exchange operation.

By means of the embodiment according to FIG. 1, it was explained that the spinning points 9, 19 of that embodiment are successively supplied alternately by cans 11 of the front row and cans 10 of the back row. This sequence does not have to be strictly observed, as shown, for example, in FIGS. 3 and 4. However, it must be ensured that the operating position of a can 33, 36 pertaining to a spinning point 51, 52 is known so that the exchange operation can be triggered that is in each case intended for the position in the front row or in the back row.

Figure 5:
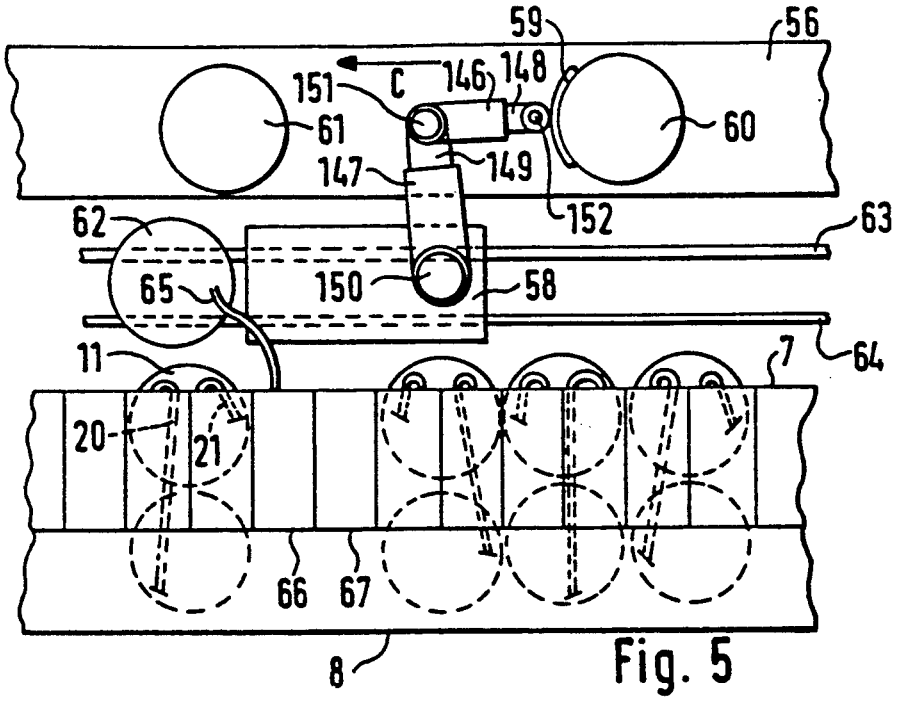
FIG. 5 is a top schematic view of another embodiment of an exchange cart.

The exchanging cart 58 shown in FIG. 5 operates according to the same principle as the exchanging cart 37 of FIG. 3 and 4. However, exchanging cart 58 has no depositing platform so that, by means of its gripper 59, during the exchange of a can of the back row, it deposits the can 62 of the front row at a site in the area of the operating path, for example, on the driving rails 63, 64 of exchanging cart 58. A full can 60 is supplied on a conveyor belt 56 moving in the direction of the arrow (C) along the operating side 7 of the machine from which the gripper 59 removes this full can. In this embodiment, it is provided that the exchanging cart 58 has only one gripper 59 which previously has deposited the exchanged empty can 61 on the same conveyor belt 56 which thus is also used for removing the empty cans. The gripper 59 is carried by two lever arms 146, 148 and 147, 149 which are connected with one another by means of a joint 151. Lever arm 146, 148, by means of another joint 152, is connected to the gripper 59. Lever arm 147, 149, by means of a rotary drive, can be swivelled around a column 150 projecting from the exchanging cart 58. Lever arms 146, 148 and 147, 149 are constructed as hydraulic or pneumatic presses so that, in addition to their swivel movement, they each can also carry out a shifting movement.

Figure 6:
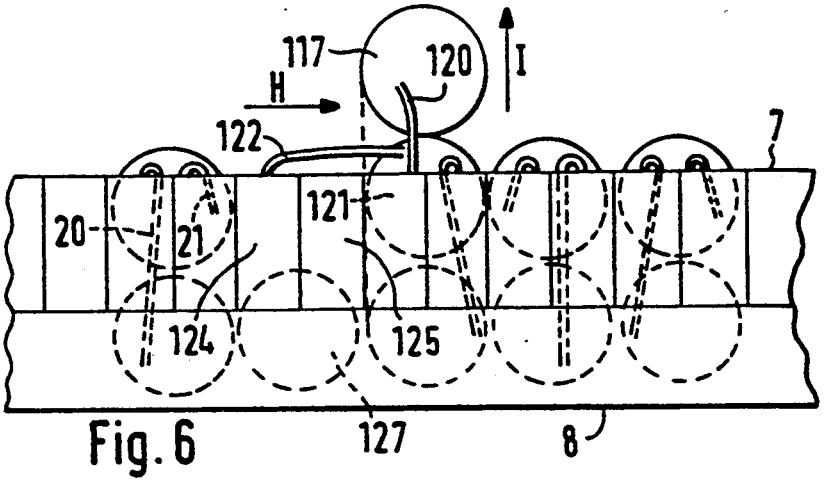
FIGS. 6 and 7 schematically illustrate possibilities of the sequence of movements during an exchange of cans.

In the embodiments according to FIGS. 3, 4 and 5, it is provided that, for making can 36, 61 of the back row accessible, the respective front can 33, 62 must carry out a relatively large movement into an intermediate depositing location. In this case, there is the risk that the sliver 53, 65, which continues to be withdrawn from it, may catch on some components and/or may hinder the manipulating with the can of the back row. It is also contemplated to provide shorter can movements for the intermediate depositing position. This is illustrated, for example, in the embodiment according to FIG. 6 which may also be carried out with the explained exchanging carts. For the exposing of a can 127 of the back row, it is provided that first a can 117 which is adjacent to the can 121 of the front row is moved out of the machine in the direction of the arrow (I), the length of this path corresponding approximately to the diameter of the can 117. In this case also, the sliver moving into the pertaining spinning point is not interrupted. Subsequently, the can 121 of the front row disposed in front of can 127 is transferred to the adjacent vacant position so that then the rear can 127 becomes accessible for a gripper of the exchanging cart. Also can 121, from which the sliver 122 moves to spinning point 124, must therefore only cover a distance of a length which corresponds approximately to the can diameter.

Figure 7:
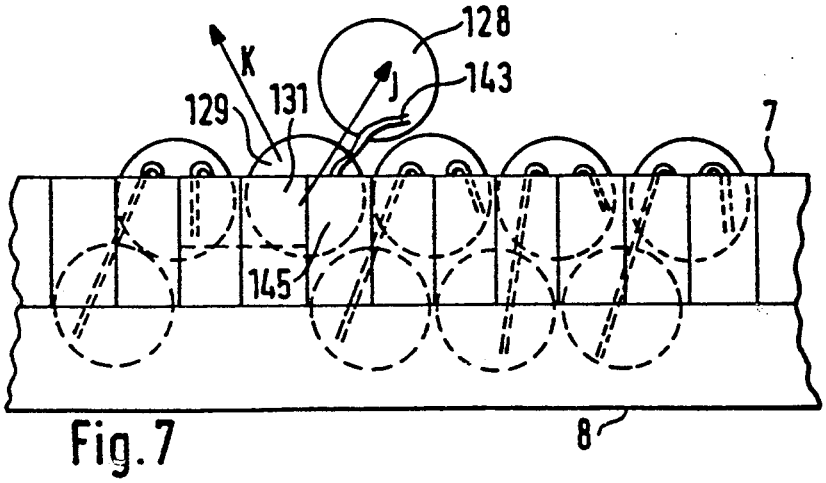

Also, only relatively short paths between the operating position and the intermediate depositing position of a can are required if the placing of the cans takes place corresponding to FIG. 7 in two rows, each can being placed opposite a respective gap. If, in this case, a can 129 of the back row is to be exchanged which is, for example, assigned to spinning unit 131, only the can 128 of spinning point 145 which stands diagonally in front of it in the front row must be moved in the direction of the arrow along a path of approximately one diameter of can 128 in the direction of the arrow (J) without hindering the entering of the sliver 143 into spinning point 145. Can 129 of the back row assigned to spinning point 131 may then first be moved out by a movement in the direction of the arrow (J) and then offset by approximately 90° with respect to that movement in the direction of the arrow (K) and may be replaced by a full can in the case of a corresponding opposite movement. Can 128 is then moved back to its location against the direction of the arrow (J). Also in the case of these sequences of movement, it is required that the exchanging cart has information on the position of the can to be exchanged by it and carries out its movement correspondingly.

In a modification of the embodiment according to FIG. 3 to 7, it is provided that the exchanging cart 37 or 58 must not distinguish between an exchange of a can of the front row or of the back row. In this embodiment, it is provided that always when a can of the front row or the back row runs empty, the two cans which are disposed behind one another (possibly also diagonally behind one another) are exchanged one after the other irrespective of whether any sliver is still contained in one of the cans. In this case, it is advantageous to equip the exchanging cart or its gripper with a cutting device or the like by means of which it is applied to the area of the entering sliver and by means of which it cuts the sliver which may still be moving from one of the two cans into the spinning point that pertains to this can.

Figure 8:
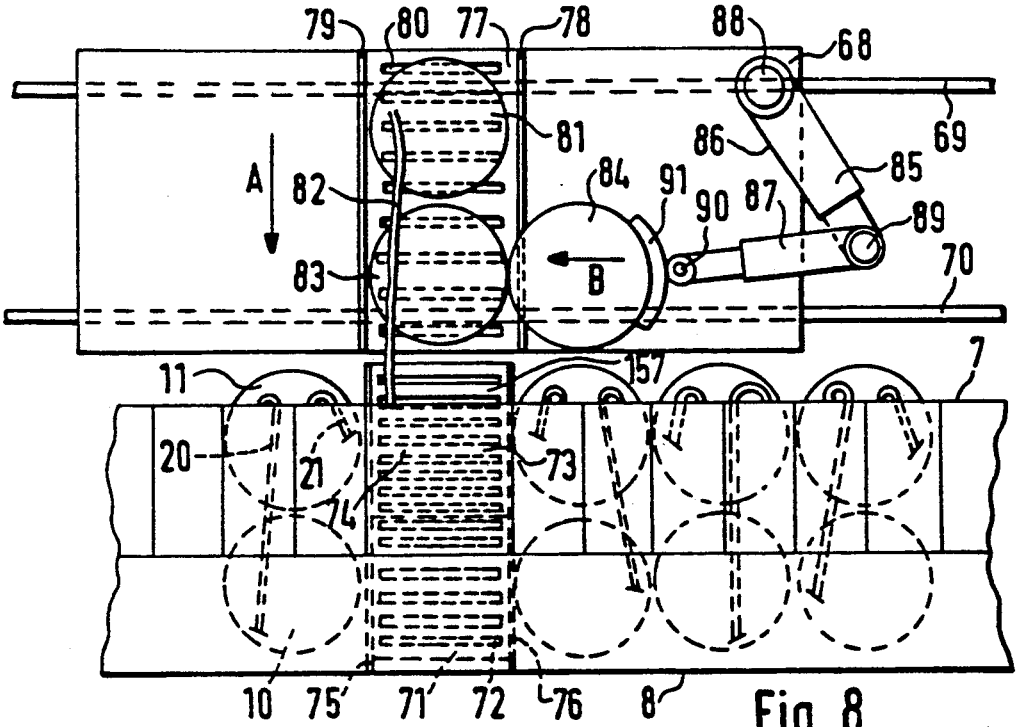
FIG. 8 is a schematic top view of another embodiment of a piecing cart and a development of the depositing locations for cans.
Figure 9:
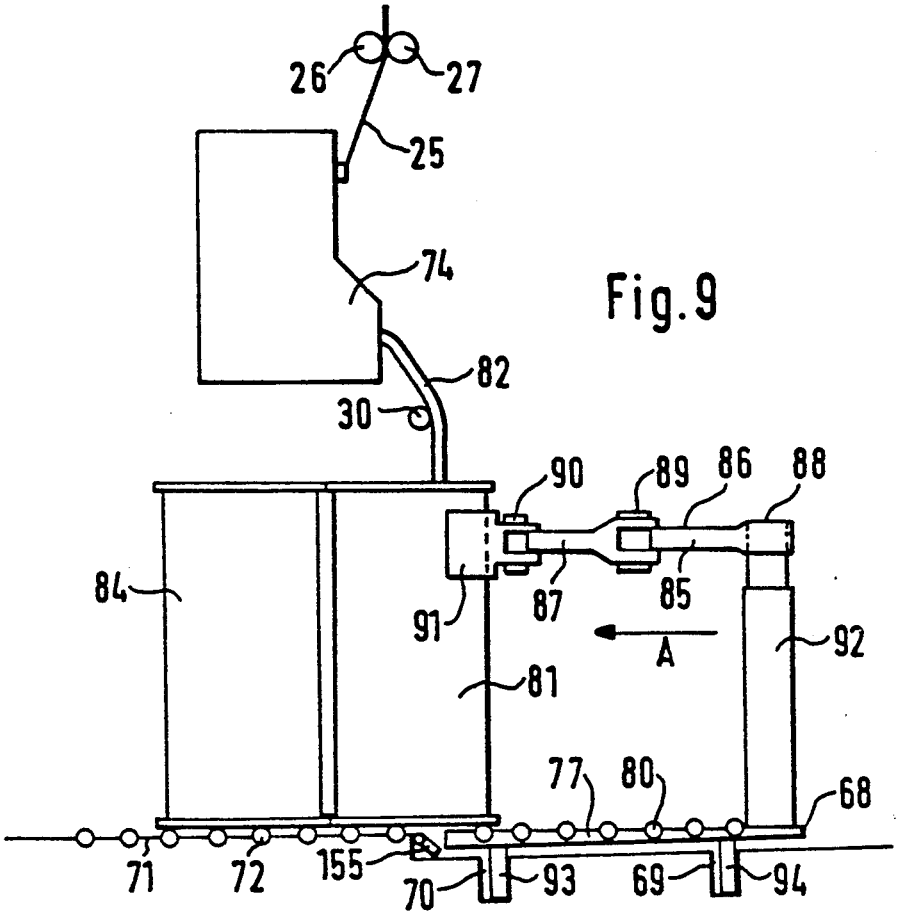
FIG. 9 is a schematic lateral view of the embodiment according to FIG. 8.

In the embodiment according to FIG. 8 and 9, the depositing locations of the cans 81, 83 are provided with small-roller paths below the spinning points 73, 74 which may, for example, consist of a sheet metal bottom 71 with embedded rollers 72. The axes of the small rollers 72 extend in the longitudinal direction of the machine. Between the depositing locations which are adjacent in the longitudinal direction of the machine, guiding ledges 75, 76 are provided which align the cans 81, 83 in the longitudinal direction of the machine.

The exchanging cart 68 is also equipped with a small-roller path which in a corresponding manner comprises a metal sheet 77 with embedded small rollers 80, the axes of which extend in the longitudinal direction of the machine. The exchanging cart 48, by means of running wheels 93, 94, of which at least one is drivable, moves on rails 69, 70 embedded in the bottom.

In this embodiment also, it will at first be assumed that a can 83 of the back row has run empty and must be changed correspondingly, while can 81 of the front row still contains sliver 82 which, also during the exchange of cans, is supplied to the pertaining spinning point 74 in an unchanged manner.

The exchanging cart 68 is applied to the spinning point 73 to be serviced in such a manner that its small-roller path 77, 80 extends as a lengthening of the small-roller path 71, 72 which is assigned to this spinning point 73 and the adjacent spinning point 74. Small-roller path 71, 72 and small-roller path 77, 80 have a gradient as a result of which the cans 83, 81, after the opening-up of a lock 155, as the result of the force of gravity, automatically move transversely out of the machine onto the depositing platform of the exchanging cart 68 equipped with the small-roller path 77, 80.

The exchanging cart 68 is equipped with a gripper 91 which already holds a full can 84 available. The gripper 91 which, by way of swivel arms 85, 87 by means of a column 88 projecting away from the exchanging cart 68, is held by way of joints 89, 90 and drives, already holds a full can 84 available. By means of a movement in the longitudinal direction of the machine (direction of arrow B), the empty can 83 is pressed out of the small-roller path 77, 80 and is replaced by a full can 84. The gripper 91 is then (FIG. 9) applied to the can 81 of the front row in such a manner that it presses it, together with the refilled can 84, back into the depositing locations under spinning point 74. Then the can exchange operation is concluded. When leaving the spinning point 73, the exchanging cart 68 ensures that the lock 155 latches again and secures the cans 81, 84.

An exchange of the can 81 of the front row takes place in a very similar manner, in which case the gripper 91 naturally does not replace can 83 but replaces the empty can 81 by the full can 84.

The exchanging cart 68 may carry along one or several full cans 84 on its depositing platform. It may then also remove the exchanged empty cans 83 on the depositing platform which is opposite with respect to the small-roller path 77, 80. It is also possible for the gripper 91, in each case, to remove a full can 84 from the independent conveying device, such as a conveyor carriage 12 corresponding to FIG. 1 or a conveyor belt and to also transfer the empty can 83 to this conveyor carriage or conveyor belt.

Laterally of the small-roller path 77, 80 of the exchanging cart 68, guide rails 78, 79 are provided which provide that the cans 81, 84 are also guided exactly in the transverse direction with respect to the machine, i.e., in and out of the depositing locations. These guide rails are preferably liftable and lowerable so that the lateral sliding-in of full cans 84 and the lateral pushing-out of empty cans 83 is not hindered.

Figure 10:
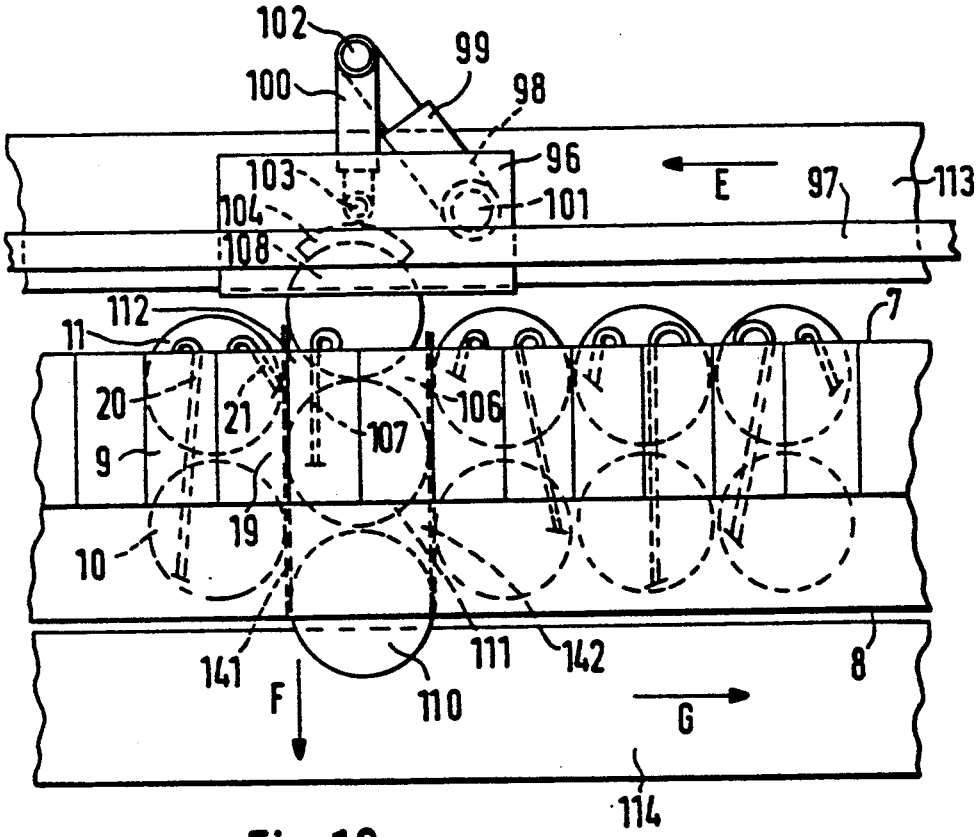
FIG. 10 is a schematic partial top view of a facility according to the invention having a conveying arrangement for supplying full cans and a conveying arrangement the removing empty cans.

In the embodiment according to FIG. 10, it is provided that a conveying device 113 in the form of a conveyor belt moves in the direction of the arrow (E)

which serves the supplying of full cans on the operating side 7 of the spinning machine, in front of the two rows of cans. Another conveyor belt 114 runs along the two rows of cans on the rear side 8 of the machine in the direction of the arrow (G). In the area of the operating side, an exchanging cart 96 is also situated which can be moved along a driving path 97 along the machine. The exchanging cart 96 is expediently arranged at a sufficient distance above the conveyor belt 113 so that the (not shown) cans disposed on it can move through under the exchanging cart 96. The exchanging cart 96 is equipped with a gripper 104 which is held by two lever arms 99, 100 of which lever arm 99 is arranged to be pivotable around a column 101 projecting away from the exchanging cart 96, this column also comprising a corresponding drive. The two lever arms 99, 100 are connected with one another by way of a joint 102. Lever arm 100 is connected to gripper 104 by means of joint 103. The columns and the joints 102, 103 are connected with one another by means of driving elements, particularly chains or toothed belts, in such a manner that the gripper 104 carries out a movement in the transverse direction toward the spinning machine (in the direction of arrow F); i.e., in the direction of the cans 11 and 10 disposed behind one another in two rows. The lever arm 100 is expediently constructed as a pneumatic or hydraulic press which can be moved out in itself so that a transverse movement of a sufficient length can be carried out.

There are several possibilities as to how the exchanging cart 96 carries out an exchange of cans.

In a first possibility, it is provided that when a can 11 of the front row has run empty, the exchanging cart 96 removes this can from the corresponding depositing location and transfers it to the conveyor belt 113 which will then also be used for the removal of the empty cans 11 of the front row. For this purpose, the exchanging cart 96 receives a corresponding information concerning the position of the can 11 pertaining to a spinning point 19 in need of servicing so that it then carries out this exchange operation. When a can of the back row has run out, such as can 110 according to FIG. 10, the exchanging cart 96 receives a corresponding information according to which it triggers another exchange operation. During this exchange operation, the gripper 104 removes a full can 108 from the belt 113 and pushes it transversely against the can 111 standing in front of this can 110. In this case, the three cans 108, 111 and 110 ar displaced simultaneously whereby can 110 reaches the conveyor belt 114 in the direction of arrow (F) and is moved away in the direction of arrow (G). Can 111, which previously had stood in the first row, as a result, was moved into the second or back row. This displacement into the back row takes place without any breakage of the sliver 107. A full can now stands in the front row which is then assigned to spinning unit 106. With the carrying-out of this exchange operation, an information is supplied to the central control system of the machine according to which can 111 of spinning point 112 now stands in a position in the back row, and can 108 of spinning point 106 stands in a position in the front row; i.e., in positions which are the reverse of the previous positions. When transmitting commands to the exchanging cart 96, the central control system can then take this position change into account so that the correct exchange operation is carried out.

In a modification, it is provided that the exchanging cart 96, particularly the gripper 104, is provided with an additional device which grips the sliver 107 entering into spinning point 112 and cuts it before can 111 is pushed into the position of the back row. After an exchange of cans, a new piecing of the sliver is therefore required at both spinning points 106 and 112. This is carried out manually or by means of an automatic device in such a manner that the sliver 107 of the can 111 which now stands in the back row is applied to spinning point 106, and the sliver of the full can 108 is applied to spinning point 112. Thus the previous assignment of the depositing locations or positions of the cans of the front and rear rows is maintained so that the type of the servicing operations does not have to be changed.

In a further modification, it is provided that the exchanging cart 96 carries out only one method of operation during an exchange of cans irrespective of whether the front can 111 or the rear can 110 have run empty. In this case, the exchanging cart 96, by being actuated twice and by supplying two full cans 108, pushes both cans 110 and 111, which are standing in a row behind one another, onto the conveyor belt 114. In this case, it is expedient that devices ar provided for examining whether a sliver is still entering into one of the two spinning points 106, 112 which then, by means of cutting devices connected with the gripper 104, is cut off before the cans 110, 111 are pushed out.

Although in this method of operation, there is the danger that in most cases one of the cans 110 or 111 may still contain a residual amount of sliver and may not be completely empty, this can be accepted if a sorting device is assigned to the conveyor belt 114 or a device which follows, this sorting device sorting out the cans with the sliver and returning them to the feeding side to the conveyor belt 113.

In the embodiment according to FIG. 10, it is expedient for guides 141, 142 to be provided between cans 10, 11, 110, 111 and the other cans which ensure that cans 10, 11, 110, 111, within the depositing area, can move only transversely with respect to the machine.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A facility having a plurality of spinning units and at least one exchanging cart for the exchange of empty cans for full cans at respective spinning units, which cans contain a sliver to be processed and which are deposited in front and back rows behind one another adjacent the respective spinning units, wherein the exchanging cart is equipped with devices for selectively carrying out first and second different can exchange operations, said first can exchange operation comprising exchanging respective cans in a position in the front row and the second can exchange operation comprising exchanging respective cans in a position of the back row, wherein a depositing location for the pertaining can in the front and back row is assigned to each spinning point, and wherein devices are provided for supplying a signal to the exchanging cart concerning the depositing location of the can of the spinning point to be serviced and for triggering the respective required first or second can exchange operation intended for this position.

2. A facility according to claim 1, wherein the exchanging cart is equipped with devices for removing a full can from a conveying device and with devices for transferring an empty can to a conveying device.

3. A facility according to claim 2, wherein the exchanging cart is equipped with devices for making a can of the back row accessible by moving out and intermediately depositing and returning the can situated in the front row in front of it.

4. A facility according to claim 1, wherein the exchanging cart is equipped with devices for making a can of the back row accessible by moving out and intermediately depositing and returning the can situated in the front row in front of it.

5. A facility according to claim 1, wherein a conveying device is provided for supplying full cans along the front row of cans and a conveying device is provided for removing exchanged cans along the back row of cans.

6. A facility according to claim 1, wherein the depositing location of the cans is provided with roller guides which can be connected to a roller guide of the exchanging cart.

7. A facility according to claim 1, wherein lateral guides are provided between the depositing locations transversely with respect to the longitudinal direction of the machine.

8. A facility having a plurality of spinning units and at least one exchanging cart for the exchange of empty cans for full cans at respective spinning units, which cans contain a silver to be processed and which are deposited in front and back rows behind one another adjacent respective spinning units, wherein the exchanging cart is equipped with devices for displacing a can of the front row to a depositing location of the back row and for the simultaneous moving of the can previously situated in the back row to a conveyor device moving along the back row, and with devices for depositing a full can in the depositing location of the front row which has become vacant.

9. A facility according to claim 8, wherein devices are provided for changing the information concerning the changed position of the can assigned to a spinning unit and displaced from the front row to the back row.

10. A facility according to claim 9, wherein a conveying device is provided for supplying full cans along the front row of cans and a conveying device is provided for removing exchanged cans along the back row of cans.

11. A facility according to claim 8, wherein the exchanging cart is equipped with devices for the cutting of a sliver moving from can of the front row to the pertaining spinning unit.

12. A facility according to claim 8, wherein the depositing location of the cans is provided with roller guides which can be connected to a roller guide of the exchanging cart.

13. A facility according to claim 8, wherein lateral guides are provided between the depositing locations and arranged transversely with respect to the longitudinal direction of the machine.

14. A facility having a plurality of spinning units and at least one exchanging cart for the exchange of empty cans for full cans at respective spinning units, which cans contain a sliver to be processed and which are deposited in front and back rows behind one another adjacent the respective spinning units, wherein the exchanging cart is equipped with devices for the subsequent selective exchange of the cans standing behind one another in two rows which can be actuated as a function of signals indicating the running-empty of the front and/or the rear can, and wherein the exchanging cart comprises devices for cutting a sliver moving from a can of the front row or can of the back row to the pertaining spinning point.

15. A facility according to claim 14, wherein a conveying device is provided for supplying full cans along the front row of cans and a conveying device is provided for removing exchanged cans along the back row of cans.

16. A facility according to claim 14, wherein the depositing location of the cans is provided with roller guides which can be connected to a roller guide of the exchanging cart.

17. A facility according to claim 14, wherein lateral guides are provided between the depositing locations and arranged transversely with respect to the longitudinal direction of the machine.

* * * * *